US006491269B1

(12) United States Patent
Larson et al.

(10) Patent No.: US 6,491,269 B1
(45) Date of Patent: Dec. 10, 2002

(54) GAS SPRING QUICK RELEASE MECHANISM AND METHOD OF USE

(76) Inventors: John E. Larson, P.O. Box 1197, Hamilton, MT (US) 59840; Wayne R. Veltri, 3906 Houk Way, Stevensville, MT (US) 59870

( * ) Notice: Subject to any disclaimer, the term of this patent is extended or adjusted under 35 U.S.C. 154(b) by 0 days.

(21) Appl. No.: 09/566,212

(22) Filed: May 5, 2000

Related U.S. Application Data

(60) Provisional application No. 60/132,715, filed on May 6, 1999.

(51) Int. Cl.[7] ..... F16M 11/26

(52) U.S. Cl. ..... 248/188.5; 248/161; 248/599

(58) Field of Search ..... 248/188.5, 563, 248/593, 594, 595, 599, 600, 161, 622, 631, 188.2, 157, 404; 297/344.19

(56) References Cited

U.S. PATENT DOCUMENTS 3,547,394 A * 12/1970 Wehner ..... 248/412
3,788,587 A * 1/1974 Stemmler ..... 248/562
3,921,952 A * 11/1975 Wirges ..... 248/404
4,072,288 A * 2/1978 Wirges et al. ..... 248/404
4,156,523 A * 5/1979 Bauer ..... 267/120
4,240,619 A * 12/1980 Wirges et al. ..... 267/64.11
4,283,033 A * 8/1981 Bauer ..... 248/188
4,318,526 A * 3/1982 Werner ..... 248/412
4,692,057 A * 9/1987 Lauderbach ..... 403/334
4,756,496 A * 7/1988 Hosan et al. ..... 248/161
4,969,619 A * 11/1990 Bauer et al. ..... 248/161
5,284,312 A * 2/1994 Dony ..... 248/161
6,224,155 B1 * 5/2001 DeKraker et al. ..... 297/344.12

* cited by examiner

*Primary Examiner*—Anita King
(74) *Attorney, Agent, or Firm*—Saliwanchik, Lloyd & Saliwanchik

(57) ABSTRACT

The present invention is a height adjustable pedestal having a gas spring which is easily separated from a furniture component support. The height adjustable pedestal of the present invention can be used in chairs and table. The present invention also provides a method of releasing the tapered upper section of the gas spring from the socket in which it is retained. The method involves no impact forces. The pry lever can be used to apply a force directly on the top of the gas spring cylinder. The invention allows the gas spring to be released simply without the possibility of damage to the gas spring, or other chair component.

10 Claims, 5 Drawing Sheets

72

36
34
32
30
24
70
20
22

38
10
40

GAS SPRING QUICK RELEASE MECHANISM AND METHOD OF USE

RELATED APPLICATIONS

The present application claims the benefit under Title 35, United States Code, Section 119E of the U.S. Provisional Patent Application Ser. No. 60/132,715, filed May 6, 1999 entitled "Gas Spring Quick Release Mechanism and Method".

BACKGROUND

Height adjustable work chairs are used in home, office, education, and industry. These height adjustable chairs typically include a seat that swivels in relation to the base of the chair. The height adjustment is typically obtained from a telescoping spring height adjustment mechanism which is usually a gas spring. This gas spring is a telescoping column that includes a cylinder which includes a pressurized gas such as nitrogen; a piston extending downwardly from the cylinder which supports the cylinder in an elevated position and includes an end which secures the gas spring to the chair base; and a valve located within the cylinder which allows the movement of gas within the cylinder.

The upper section of the cylinder is typically tapered and is secured within a tapered socket within a furniture component support mechanism. The furniture component support mechanism is used to support a furniture component such as a chair seat or table top. If the furniture component support mechanism supports a chair seat, the mechanism may be referred to as a chair seat support mechanism. The chair seat support mechanism is also known as the chair tilt mechanism, particularly on chairs with adjustable backrests or chairs having a tilting chair seat.

Also included in the furniture component support mechanism is a lever that actuates the valve located in the gas spring. The valve typically includes a button extending from the top of the cylinder. When the button is depressed by the lever the pressurized gas within the cylinder is allowed to move through the valve. The cylinder will descend if a force exceeding gas pressure is applied on the spring or raise the cylinder if no force is applied on the spring. The gas spring may additionally include an air or oil damping mechanism which slows the rate of compression and extension for the gas spring.

The gas spring is typically supported in a vertical position between a base and a furniture component support by a vertical stand tube. The stand tube includes a top opening sized so that the cylinder of the gas spring can move vertically and rotationally in relation to the stand tube, yet remain supported by the stand tube regardless of the vertical or rotational position of the cylinder. The stand tube is typically a metal cylinder which includes top and bottom ends. An opening on the top end is included which is sized to accommodate a gas spring cylinder which moves vertically in relation to the stand tube. In some instances a bushing may be disposed within the opening to minimize friction between the gas spring cylinder and the stand tube. The opening serves to both guide the gas spring cylinder as well as to vertically support the gas spring which extends between the chair seat support mechanism and the chair base.

The bottom end of the stand tube cylinder typically is tapered for insertion into a base. The tapered bottom end is typically pressed into a tapered socket at the hub or center of the base. The stand tube bottom typically includes an opening through which the distal end of the piston of the gas spring can extend so as to be secured to the bottom of the stand tube. Typically, a clip type fastener is typically used to secure the distal end of the piston of the gas spring to the bottom of the stand tube.

During assembly of a chair the tapered upper section of the gas spring cylinder is seated, or secured, into the socket of the gas spring support mechanism. Similarly, during the assembly process the tapered end of the stand tube is seated within the tapered socket of the chair base.

During use of the chair, the weight of the chair user is transferred from the chair seat to the chair base through the gas spring/stand tube assembly. Because of this, the tapered upper section of the gas spring cylinder can become very securely pressed into the socket of the gas spring support mechanism.

Replacing a damaged gas spring typically involves the replacement of the entire gas spring/stand tube assembly. For this reason, the tapered upper section of the gas spring cylinder must be released from the socket within the gas spring support mechanism. Additionally, the tapered end of the stand tube must also be released from the chair base. This procedure is required to replace a damaged gas spring such as one which has developed excessive play or one which has lost internal gas pressure.

Release of the gas spring cylinder from the socket of the gas spring support mechanism typically requires a sharp impact force applied to the chair seat. The force of this impact will eventually cause the release of the tapered upper section of the gas spring cylinder from the socket. This impact force, however is transferred directly through the chair seat, and may in result in damage to the chair seat or another chair component.

In the event that the procedure needs to be done in view of the chair owner, the chair owner would watch a hammer wielding technician or sales person disassemble the chair. Multiple hammer blows is hardly the type of treatment that the chair owner expects their expensive chair should receive in this circumstance.

For this reason, there is needed a mechanism which assists the removal of the tapered upper section of the gas spring cylinder from the socket within the furniture component support within which it is secured.

SUMMARY

The present invention is a height adjustable pedestal having a gas spring which is easily separated from a furniture component support. The height adjustable pedestal of the present invention can be used in chairs and tables. The present invention also provides a method of releasing the tapered upper section of the gas spring from the socket in which it is retained. The method involves no impact forces. The pry lever can be used to apply a force directly on the top of the gas spring cylinder. The invention allows the gas spring to be released simply without the possibility of damage to the gas spring, or other chair component.

Depending on the type of furniture component support used in the pedestal, access holes which allow for the quick release pry lever to be used are provided within the furniture component support. In some versions of the invention, the access holes provide a surface on which the pry lever can pivot. In other version, a separate pivot surface is provided within the furniture component support. The inclusion of access holes in a chair seat support or other furniture component support does not represent any difficulty for the manufacturer. Because of this, the invention provides significant benefits at little cost to chair assemblies. The invention would work equally well in table assemblies that use telescoping gas spring assemblies.

The present invention greatly eases the process of gas spring replacement as it is performed in height adjustable pedestals. Through the use of the present invention, the chair owner or service technician is ensured that no damage to the chair will result from the release of the gas spring from the furniture component support within which it has been disposed. No damaging hammer blows will be applied to the chair seat.

These and other features and advantages of the present invention will be apparent upon inspection of the following drawings, description, and claims.

DRAWINGS

FIG. 1A-2 shows a side view of a second portion of one version of a height adjustable pedestal of the present invention.

FIG. 1D show a top view of a furniture component support including a pry lever.

FIG. 1E shows a side view of the upper section of a gas spring with a pry lever disposed above the top surface of the gas spring.

DESCRIPTION

Figures 1, 1A, 1B, 1C:
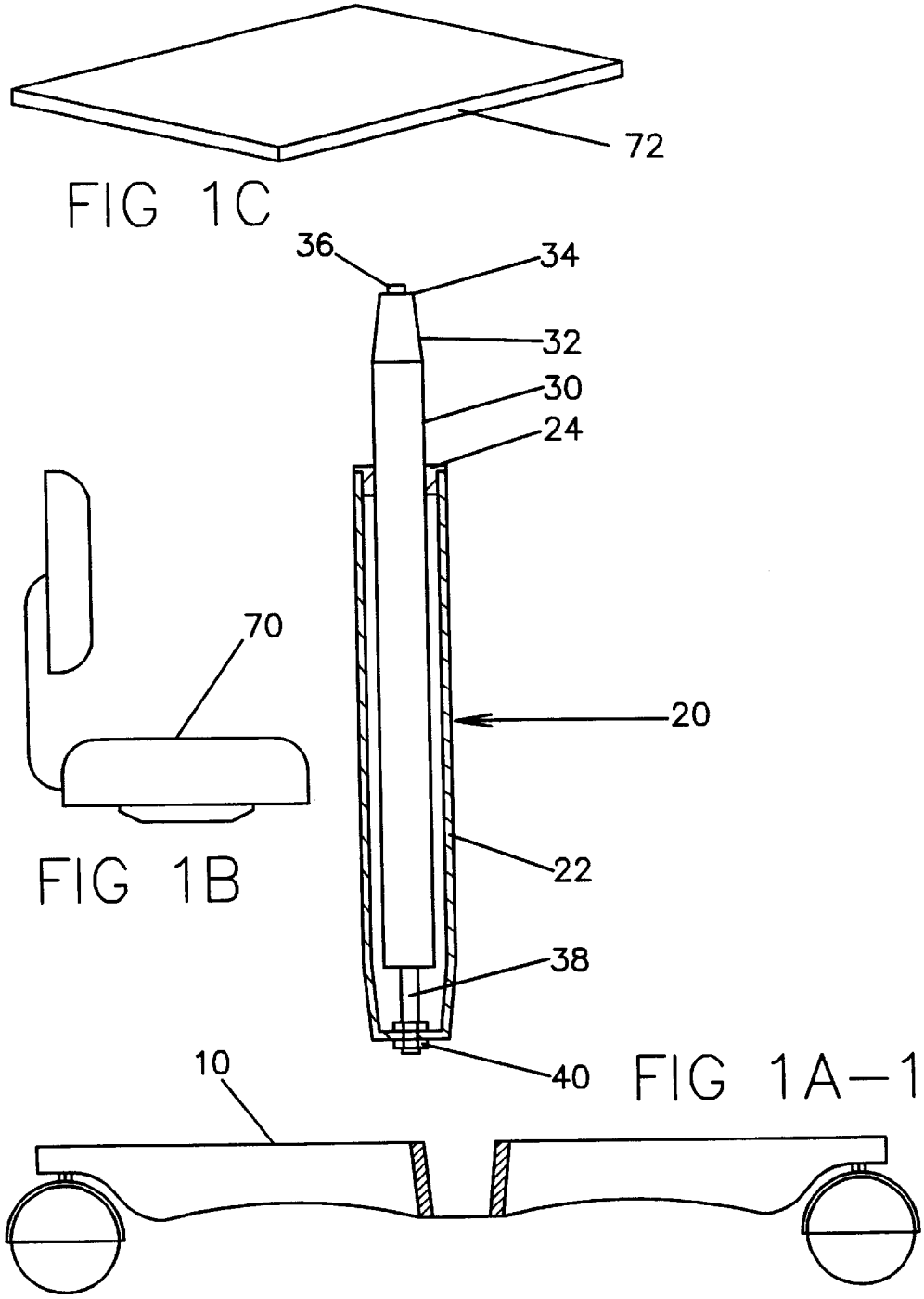
FIG. 1A-1 shows a side view of a portion of one version of a height adjustable pedestal of the present invention.
FIG. 1B shows a chair seat which could be used with the height adjustable pedestal of the present invention.
FIG. 1C shows a table top which could be used with the height adjustable pedestal of the present invention.
Figure 1:
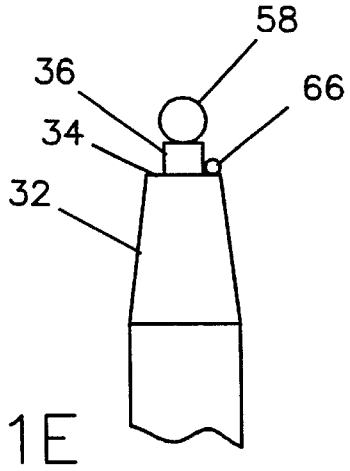
Figure 1:
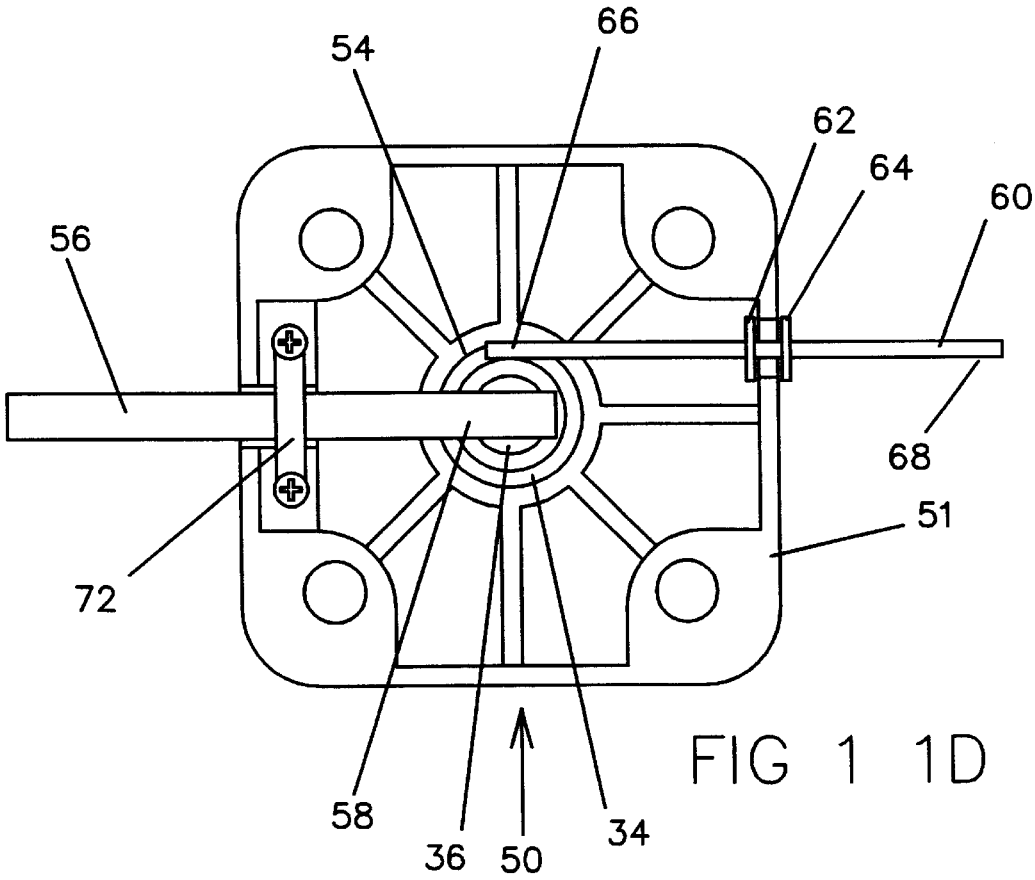
Figures 1, 1A, 2:
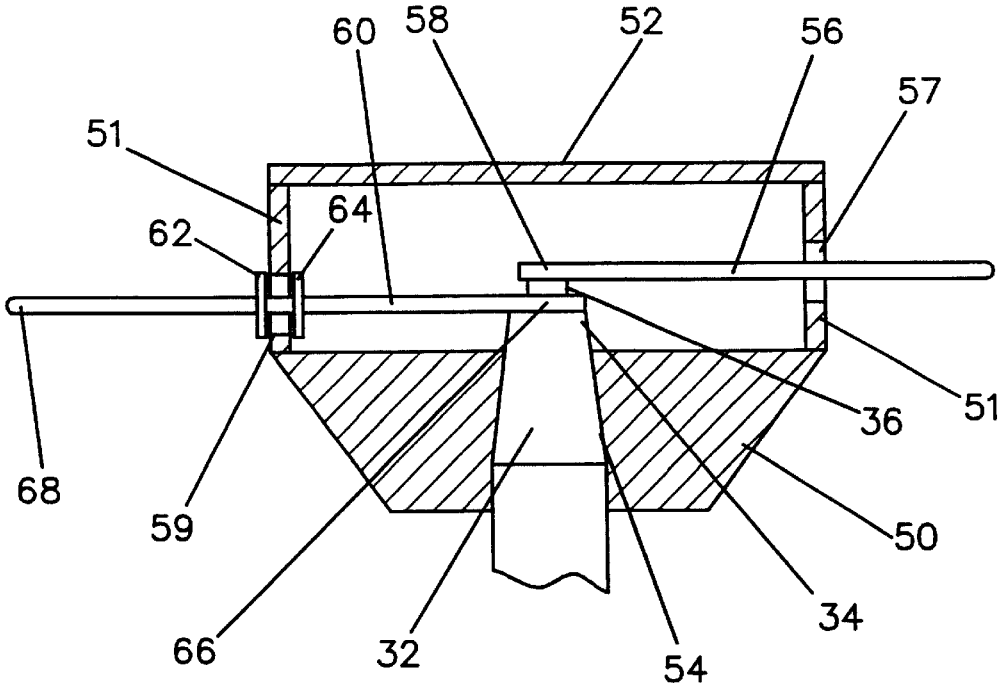

FIGS. 1A-1 and 1A-2 show a side view of one version of a height adjustable pedestal of the present invention. FIG. 1A-1 shows a base 10, a height adjustable column which is a gas spring/stand tube assembly 20. The gas spring/stand tube assembly 20 includes a gas spring 30 which is one version of a telescoping spring height adjustment mechanism usable within the height adjustable pedestal. A stand tube 22 is used to support the gas spring 30. The stand tube is a metal tube and includes a top opening 24 within which the gas spring is supported. The bottom of the stand tube is secured within a socket in the base 10. The gas spring 30 includes a cylinder 32 and a piston 38 rod which extends downwardly from the cylinder. The bottom of the piston rod is secured to the bottom of the stand tube by a clip 40. The upper section of the gas spring 30 includes a top surface 34 and a tapered conical portion beneath the top surface. An actuation button 36 extends from the top surface of the gas spring. A resilient spring material in the gas spring cylinder is pressurized gas, typically nitrogen.

A furniture component support 50 is shown in partial cross section in FIG. 1A-2. The furniture component support 50 includes a peripheral wall 51, a top surface 52 on which a furniture component such as a chair seat or table top may be supported. A socket 54 is shown within the furniture component support, and within which the tapered upper section of the gas spring is secured.

The furniture component support 50 includes an actuation lever 56 and a pry lever 60. The actuation lever 56 includes a first end 58 which is disposed above the actuation button 36. The actuation lever 56 is used to move the valve actuation button 36 by pressing downwardly on the button. The actuation lever serves to unlock the gas spring. Once the gas spring is unlocked, relative movement between the cylinder and piston can occur. The actuation lever toggles between a first position where the button is not depressed and a second position where the button is depressed. The actuation lever is disposed through an opening 57 within the peripheral wall of the furniture component support.

A pry lever 60 is disposed on the furniture component support opposite the actuation lever. The pry lever includes a first end 66 and a second end 68. The pry lever first end 66 presses downwardly on the top surface 34 of the gas spring resulting in the separation of the tapered upper section of the gas spring from the socket 54 of the furniture component support. The pry lever 60 passes through opening 59 disposed within the peripheral wall of the furniture component support. The wall of the opening 59 provides a pivot surface for the pry lever. The pry lever in this version also includes retaining washers 62 and 64 which serve to retain the pry lever in a usable position on the furniture component support.

FIG. 1B shows a chair seat 70 and FIG. 1C shows a table top 72 which could be used with the height adjustable pedestal of the present invention.

FIG. 1D shows a top view of the furniture component support 50. The actuation lever 56 is shown having a first end 58 which presses on the actuation button 36 of the gas spring. A pivot 72 serves as the fulcrum and as a retainer for the actuation lever. The pry lever 60 is shown passing through the peripheral wall 51 of the furniture component support. As was previously shown in FIG. 1A, an opening (not shown) is provided within the wall 51 through which the pry lever passes. Retaining washers 62 and 64 serve to retain the pry lever in position within the furniture component support.

The pry lever includes a first end 66 which is disposed above the top surface 34 of the gas spring. The second end 68 of the pry lever serves as the end which will be moved upwardly forcing the first end downwardly onto the top surface 34 of the gas spring. The downward force applied by the first end 66 presses on the top surface 34. This downward force results in the release of the tapered upper portion of the gas spring from the socket 54 within which it is disposed.

FIG. 1E shows the upper section of the gas spring including the tapered section 32 of the cylinder, and the cylinder top surface 34. An actuation button 36 extends upwardly from the top surface 34. The actuation lever first end 58 is shown in cross section disposed above the actuation button 36. The pry lever first end 66 is shown disposed above the top surface 34 of the gas spring cylinder.

Figure 1F:
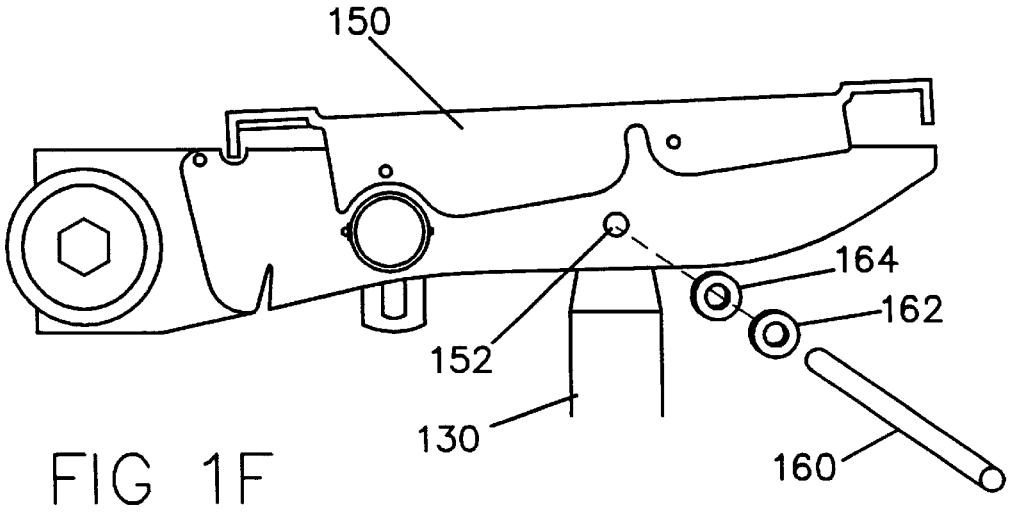
FIG. 1F shows a side view of a specific furniture component support, a chair tilt mechanism and a pry lever usable with the chair tilt mechanism.

FIG. 1F shows a chair tilt mechanism 150 which includes an opening 152. The chair tilt mechanism is a specific type of furniture component support, and as its name suggests is used to support a chair seat and a chair backrest. A pry lever 160 is shown prior to assembly into the chair tilt mechanism where the pry lever can be used to release the gas spring from a socket (not shown) within the chair tilt mechanism 150. Although the socket has not been shown in this figure, such chair tilt mechanism are commonly part of an assembly that includes a socket. The sockets within these chair tilt mechanisms are typically integrated directly into the chair tilt mechanism. Alternatively, the chair tilt mechanism could straddle a furniture component support such as been shown in FIGS. 1A and 1D. In either case, the opening 152 may provide a pivot surface for the pry lever 160 or a pivot surface other than the opening could be provided. The pry lever retaining washers 162 and 164 are also shown prior to assembly.

Figure 2B:
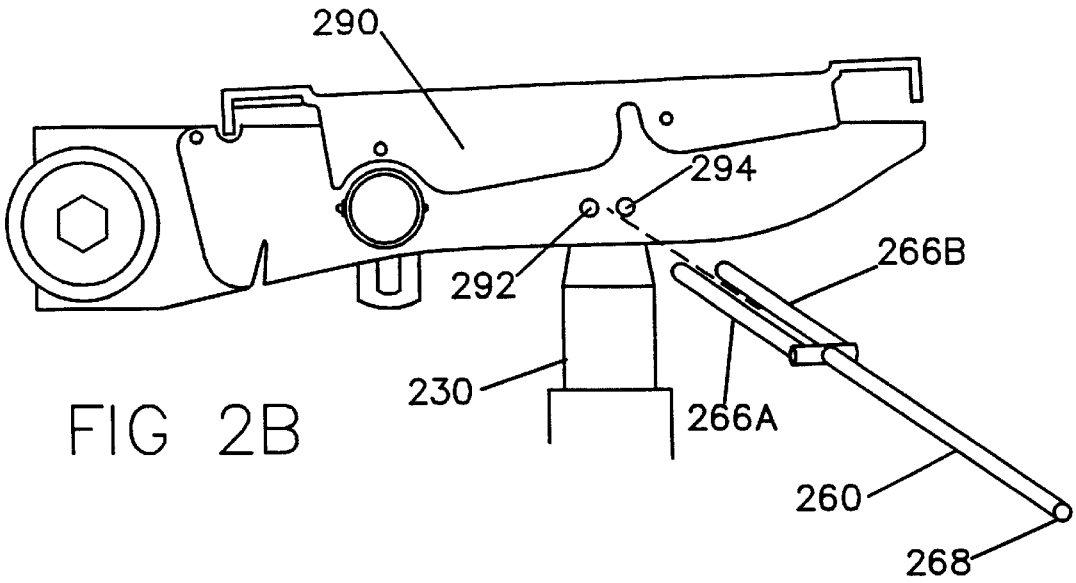
FIG. 2B show the second version of the pry lever used with a chair tilt mechanism.
Figure 2A:
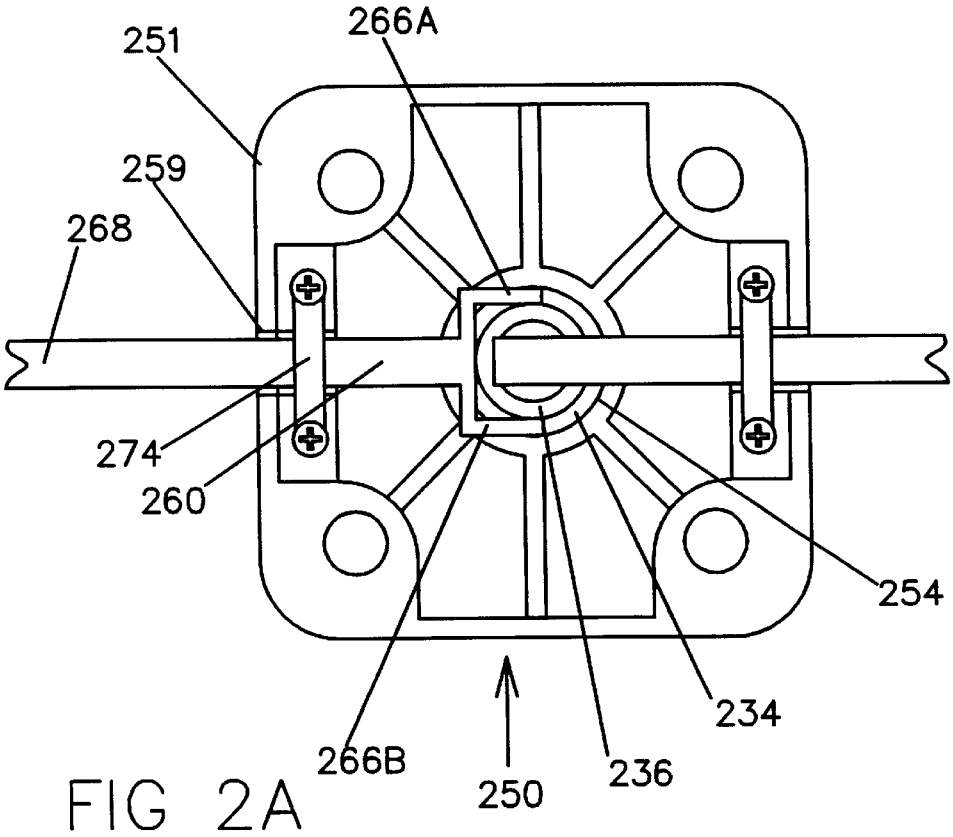
FIG. 2A shows a top view of a furniture component support including a second version of the pry lever.

FIG. 2A shown a modified version of the invention. As shown, this version includes a furniture component support 250, which includes a peripheral wall 251. The peripheral wall includes an opening 259 through which a pry lever 260 has been inserted. The pry lever 260 includes a forked first end having ends 266A and 266B, and a second end 268. The forked ends contact the top surface 234 of the gas spring at opposite sides of the actuation button 236. The pry lever 260 pivots about a pivot surface 274 horizontally disposed within the furniture component support. The upper section of the gas spring can be released from the socket 254 by moving the second end of the pry lever upwardly. This causes the pivoting of the pry lever about the pivot surface, resulting in the forked ends pressing downwardly on the top surface of the gas spring.

FIG. 2B shows another version of the invention where a chair tilt mechanism 290 includes two openings 292 and 294. In this version the two opening themselves provide the pivot surface for the pry lever 260. The pry lever includes forked ends 266A and 266B. The forked ends of the pry lever again are used to press downwardly on the gas spring 230 causing the release of the gas spring from a socket (not shown in this figure).

The pry lever as is shown in FIG. 2B is not permanently assembled into the chair tilt mechanism. It is understood that the previous versions of the invention which used retaining washers to retain the pry lever on the furniture component support could have omitted the retaining washers. Accordingly, there is no requirement of the present invention to remain permanently attached to the furniture component support. However, as the pry lever does not represent a significant additional cost to the furniture component support, it is felt that permanently mounting the pry lever in many cases is desirable.

Although gas springs have been described throughout this description, it is understood that telescoping spring height adjustment mechanisms that include spring materials other than pressurized gas could also have been used. Metallic coil springs are also found in these devices.

Figure 3B:
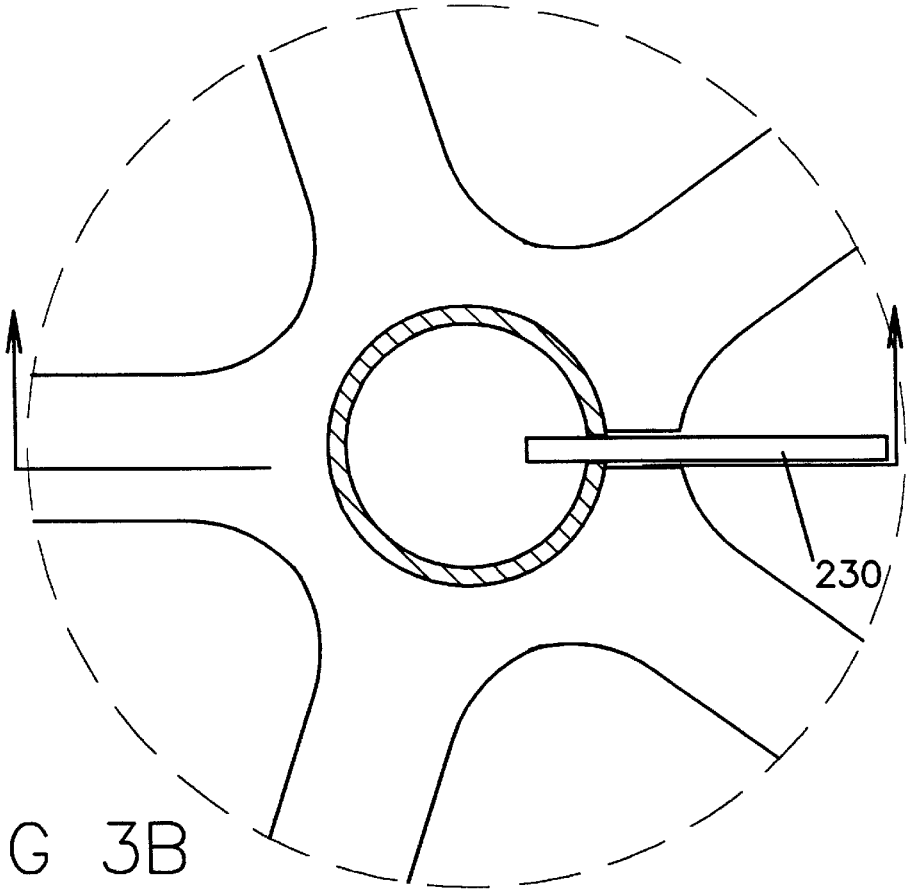
FIG. 3B shows a top view of the version of the height adjustable pedestal shown in FIG. 3A.
Figure 3A:
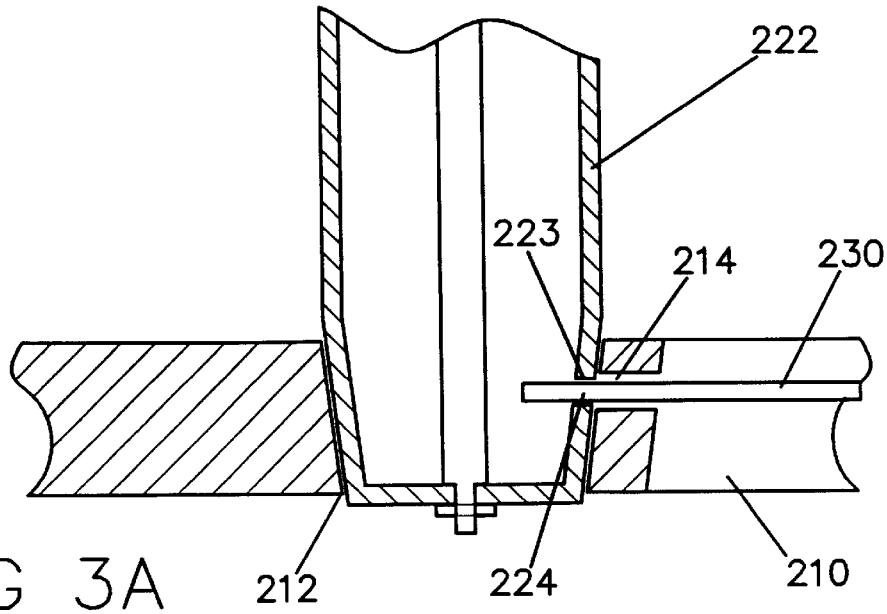
FIG. 3A shows a side view of another version of the height adjustable pedestal of the subject invention.

FIGS. 3A and 3B show another version of the invention. In this version, a base 210 includes a tapered center socket 212. A channel 214 extends horizontally through the base into the center socket. The bottom tapered portion of a stand tube 222 is disposed within the socket. The stand tube includes an opening 224. The top of the opening 224 extends to a vertical position below the top of the channel 214. A pry lever 230 is inserted through the channel and through the opening into the interior of the stand tube. Pressing downward on the pry lever causes the pry lever to pivot about the bottom surface of the channel. Upon pivoting, the pry lever will push upwardly on the top surface of the opening within the stand tube. The pry lever needs to move the stand tube vertically a very small distance to release the stand tube from the socket within the base.

It is understood that various other modifications and changes of form or detail could readily be made without departing from the spirit of the invention. It is intended that the invention be not limited to the exact form and detail herein shown and described, nor to anything less than the whole of the invention disclosed and hereinafter claimed.

We claim:

1. A height adjustable pedestal comprising:

a vertically disposed height adjustable column including a floor contacting surface;

wherein the vertically disposed height adjustable column includes: a stand tube; wherein the stand tube includes an upper section and a lower section; means for supporting the stand tube; wherein the means for supporting the stand tube includes an upward facing socket for supporting the stand tube in a substantially vertical position; wherein the lower section of the stand tube is disposed within the socket; and, a telescoping spring height adjustment lifting mechanism; wherein the telescoping spring height adjustment lifting mechanism includes a resilient spring material; wherein the stand tube supports the telescoping spring height adjustment lifting mechanism; wherein a portion of the telescoping spring height adjustment lifting mechanism extends vertically above the stand tube and moves relative to the stand tube;

wherein the vertically disposed height adjustable column further includes: a lever for prying the lower section of the stand tube from the socket; a first lever contact surface disposed on the means for supporting the stand tube; a second lever contact surface disposed on the stand tube; wherein the lever when prying the lower section of the stand tube from the socket contacts the first and second lever contact surfaces; and wherein the lever moves from a first position where the lever merely contacts the first and second lever contact surfaces, to a second position where the lever moves the first and second lever contact surfaces away from each other;

a furniture component support disposed vertically above the height adjustable column and supported by the height adjustable column; wherein the furniture component support is adapted for support of a furniture component.

2. The height adjustable pedestal of claim 1, wherein the socket includes an opening extending through the socket; and, wherein the lower section of the stand tube includes an opening extending through the stand tube; and wherein openings are aligned when the stand tube lower section is disposed within the socket; and, wherein the lever extends through the two openings;

and wherein the first contact surface is disposed within the opening of the socket; and wherein the second contact surface is disposed within the opening of the stand tube.

3. The height adjustable pedestal of claim 2, wherein the lever is disposed in a substantially horizontal orientation; and wherein the lever included a first end and a second end; the first end disposed through the aligned openings; and wherein the lever's first end, when moved to the second position pivots about against the first contact surface and presses against the second contact surface causing the upward movement of the lower section of the stand tube relative to the means for supporting the stand tube.

4. A height adjustable pedestal comprising:

a floor contacting base;

a height adjustable column disposed vertically above the base and supported by the base, the height adjustable column comprising a first portion attached to the base;

a telescoping spring height adjustment lifting mechanism, the telescoping spring height adjustment lifting mechanism comprising a resilient spring material; and, an upper section including a top surface; and a furniture component support disposed vertically above the height adjustable column and supported by the height adjustable column, the furniture component support adapted for support of a furniture component, the furniture component support comprising a means to support the upper section of the telescoping spring mechanism, the upper section of the telescoping spring mechanism not moving relative to the furniture component support during use of the pedestal; a pivot surface; and, a pry lever for pressing on the upper section of the telescoping spring height adjustment mechanism;

wherein pressing on the upper section of the telescoping spring height adjustment mechanism with the pry lever moves the upper section of the telescoping spring height adjustment mechanism away from the furniture component support.

5. The height adjustable pedestal of claim 4, wherein the furniture component support includes an opening; a pivot surface disposed within the opening; and wherein the pry lever is disposed within the opening.

6. The height adjustable pedestal of claim 4, wherein the telescoping spring height adjustment mechanism includes: a cylinder having a top and a bottom; and wherein the cylinder top comprises the upper section of the telescoping spring height adjustment mechanism; a piston rod extending out the cylinder bottom; and, a resilient spring disposed within the cylinder between the cylinder top and the piston rod; wherein the resilient spring pushes the piston rod and the cylinder top in opposite directions.

7. The height adjustable pedestal of claim 4, wherein the telescoping spring height adjustment lifting mechanism is lockable; and comprises a movable actuation button disposed on the upper section which extends therefrom; the movable actuation button selectively movable from a first locked position to a second unlocked position; and, wherein the lockable telescoping spring height adjustment lifting mechanism must be actuated to adjust the height of the furniture component support relative to the floor; and wherein the height adjustable pedestal further includes an actuation mechanism supported by the height adjustable pedestal for engaging and moving the actuation button of the lockable telescoping spring height adjustment lifting mechanism to the second unlocked position; and wherein pressing on the upper section of the telescoping spring height adjustment mechanism with the pry lever does not exert a force on the actuation button.

8. The height adjustable pedestal of claim 7, wherein the pry lever is disposed in a substantially horizontal orientation; and wherein the pry lever includes a first end and a second end; the first end disposed proximate to the upper section of the telescoping spring height adjustment lifting mechanism on one side of the pivot surface; and, wherein the pry lever's first end, when pivoted about the pivot surface, presses on the top surface of the telescoping spring height adjustment lifting mechanism at a location adjacent the actuation button but not on the actuation button.

9. The height adjustable pedestal of claim 4, further comprising a chair seat disposed above the furniture component support.

10. The height adjustable pedestal of claim 4, further comprising a table top disposed above the furniture component support.

* * * * *